United States Patent [19]

Rex

[11] Patent Number: 4,754,773

[45] Date of Patent: Jul. 5, 1988

[54] DISPOSABLE UMBRELLA AND METHOD OF MANUFACTURE

[76] Inventor: James R. Rex, 1017 4th St., Suite 1, Santa Monica, Calif. 90403

[21] Appl. No.: 48,093

[22] PCT Filed: Sep. 9, 1986

[86] PCT No.: PCT/US86/01867

§ 371 Date: Apr. 23, 1987

§ 102(e) Date: Apr. 23, 1987

[87] PCT Pub. No.: WO87/01262

PCT Pub. Date: Mar. 12, 1987

Related U.S. Application Data

[63] Continuation-in-part of Ser. No. 774,133, Sep. 9, 1985, abandoned.

[51] Int. Cl.[4] ..... A45B 13/00; A45B 19/00

[52] U.S. Cl. ..... 135/19.5; 40/317

[58] Field of Search ..... 135/19.5, 20 R; 40/317, 40/586

[56] References Cited

U.S. PATENT DOCUMENTS

| | | | |
|---|---|---|---|
| 1,457,679 | 6/1923 | Vincent | 135/19.5 |
| 2,552,461 | 5/1951 | Ruskin et al. | 135/19.5 |
| 2,554,204 | 5/1951 | Mueller | 135/19.5 |
| 2,563,353 | 8/1951 | Mueller et al. | 135/19.5 |
| 2,757,679 | 8/1956 | Rivkin et al. | 135/19.5 X |
| 4,062,369 | 12/1977 | Hermanson | 135/19.5 |
| 4,182,353 | 1/1980 | Hermanson | 135/19.5 |
| 4,215,711 | 8/1980 | Hermanson | 135/19.5 |
| 4,262,367 | 4/1981 | Herrin | 40/586 X |
| 4,370,993 | 2/1983 | Desaleox et al. | 135/19.5 |

FOREIGN PATENT DOCUMENTS

| | | | |
|---|---|---|---|
| 7607179 | 1/1977 | Netherlands | 135/19.5 |
| 347678 | 4/1931 | United Kingdom | 135/19.5 |

*Primary Examiner*—J. Karl Bell

*Attorney, Agent, or Firm*—Nilsson, Robbins, Dalgarn, Berliner, Carson & Wurst

[57] ABSTRACT

A disposable umbrella and the method of manufacture. The umbrella 100 has two parts: a flexible water impermeable canopy (102) and a rectangular rigid frame (104). Pocket (126, 128) are formed in two parallel sides of the canopy. The frame has outer dimensions substantially matching the outer dimensions of the canopy. A center fold line (138) in the frame defines two equal side panels (140, 142) and allows the side panels to fold together into a closed position. The canopy is fitted on the top of the frame by bending the side panels opposite the closed position until the frame sides (134, 136) slip into the canopy pockets. The panels are then returned to the closed position. Handles (156, 158) cut in the side panels fold down for use and position the umbrella in a peak-roof shape when aligned and held by one hand.

13 Claims, 4 Drawing Sheets

FIG. 5.
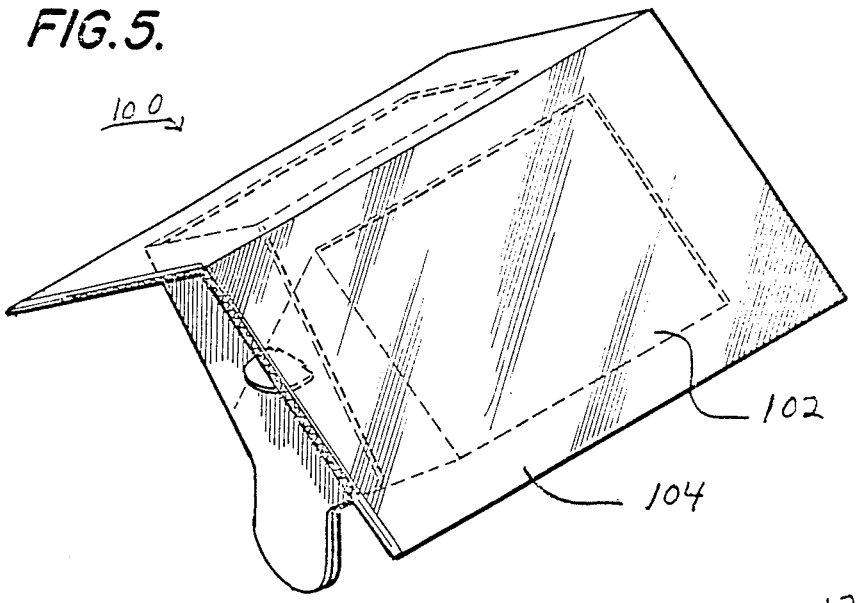
FIG. 6.
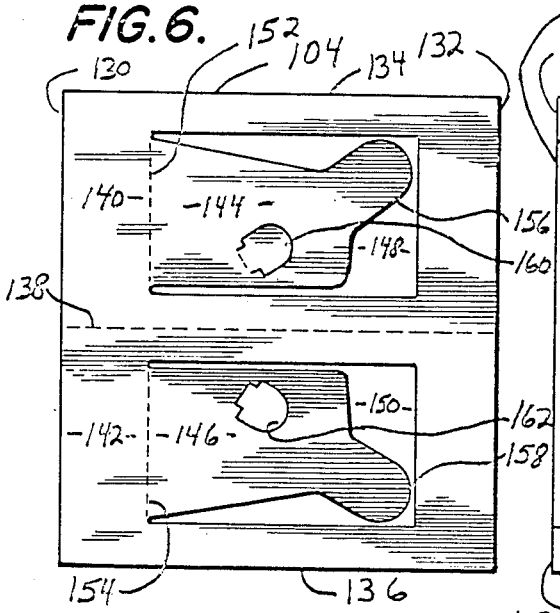
FIG. 7.
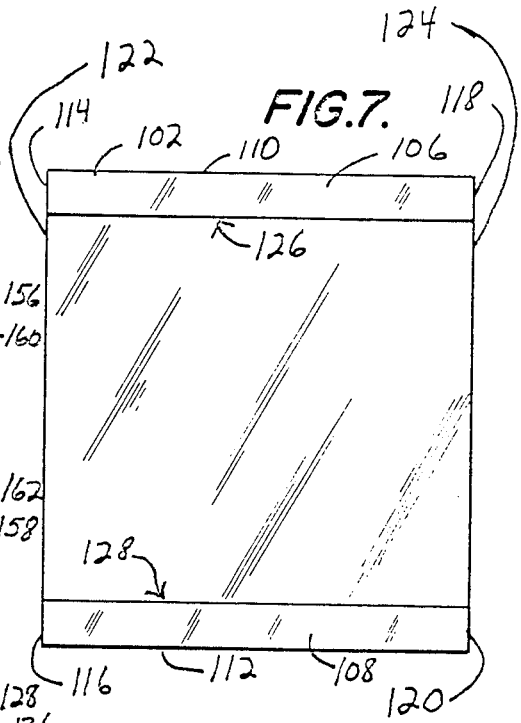
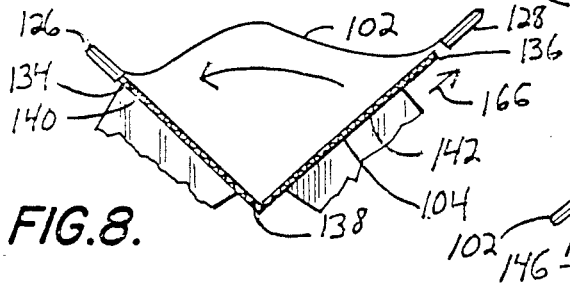
FIG. 8.
FIG. 9.
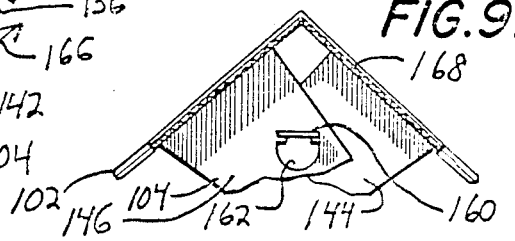

DISPOSABLE UMBRELLA AND METHOD OF MANUFACTURE

RELATED APPLICATION

This application is a continuation-in-part of applicant's previously filed application Ser. No. 774,133, filed Sept. 9, 1985 now abandoned.

BACKGROUND OF THE INVENTION

1. Field of the Invention

The present invention pertains to the umbrella art, and more particularly, to an inexpensive disposable umbrella and a method for its manufacture.

2. Background Art

Standard umbrellas are inconvenient to carry and are, therefore, often unavailable when needed. In addition, they are expensive causing their owners to leave them in the closet in order to avoid loss or damage unless they are obviously needed. The result is that many owners end up with several expensive umbrellas —all bought on impulse when required to meet unexpected weather conditions.

Numerous inexpensive and disposable umbrellas have been developed allowing purchase at convenient locations at the onset of inclement weather and then disposal after one or a few uses. Some of these disposable umbrellas are disclosed in U.S. Pat. Nos. 2,552,461; 2,563,353; 2,757,679; 4,062,369; 4,182,353; 4,215,711; and 4,370,993; and The Netherlands Patent No. 7,607,179 and United Kingdom Pat. No. 347,678. While they are relatively inexpensive in relation to the cost of a standard umbrella, many are still expensive per use, difficult to set up, or have limited durability.

SUMMARY OF THE INVENTION

The present invention is directed to a disposable umbrella and method of manufacture designed to minimize the expense while maximizing the durability and ease of set up. The umbrella is of such a size and configuration that it may be easily stored for use or sale when needed. The canopy and frame material make the umbrella an ideal sitting pad for outdoor sports events. Advertising may be included on the canopy to enhance the appearance or make a statement.

In accordance with one important aspect of the invention, the canopy is comprised of a rectangular flexible water impermeable sheet having first and second parallel sides, each side having a pocket. The frame is comprised of a rectangular rigid sheet having outer dimensions substantially matching the outer dimensions of the canopy. The frame sides are parallel to each other and are spaced substantially the width of the canopy. A center fold line is parallel to the frame sides and defines two substantially equal side panels. The side panels may be bent toward each other until the frame sides touch in a closed position. The canopy fits over the outside of the frame with one of the frame sides slipped into one pocket and the other frame side slipped into the second pocket.

One feature of the preferred embodiment is a tongue cut in each of the side panels. Each tongue has a handle and a tongue fold line for folding out the tongue. When the tongues are folded out and the handles aligned, the umbrella is positioned in a peak-roof shape.

In a preferred embodiment, a locking tab is provided on one tongue and a tab lock opening is provided on the other tongue. When the handles are aligned, the locking tab may be positioned in the tab lock opening to retain the tongues together in an aligned position thereby retaining the umbrella in a peak-roof shape without holding by hand.

In accordance with one important aspect of a second embodiment, the canopy is a vinyl sheet adhered to the outside of a corrugated cardboard panel.

BRIEF DESCRIPTION OF THE DRAWINGS

FIG. 5 is a perspective view of a preferred embodiment folded for use;

FIG. 6 is a bottom plan view of the frame of the embodiment of FIG. 5 in a flat open position;

FIG. 7 is a bottom plan view of the canopy of the embodiment of FIG. 5.

FIG. 8 is a partial end elevational view of the frame of FIG. 6 in a reverse bend position allowing the installation of the canopy of FIG. 7;

FIG. 9 is a partial end elevational view of the frame of FIG. 8 bent to the normal use position with the canopy installed;

DESCRIPTION OF THE PREFERRED EMBODIMENTS

Figure 1:
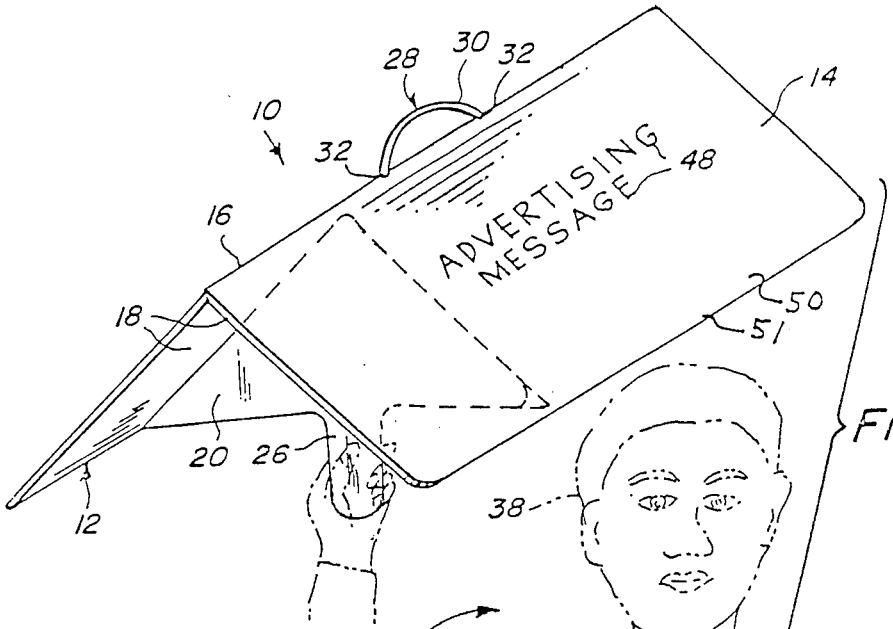
FIG. 1 is a perspective view of one embodiment of the invention in use.
Figure 2:
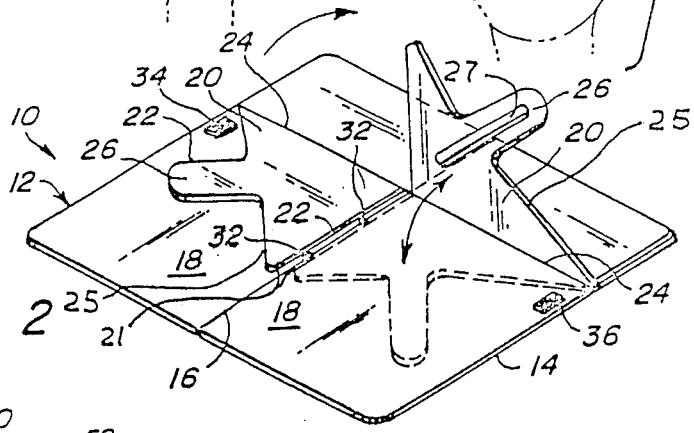
FIG. 2 is a bottom perspective view of the embodiment in FIG. 1 in a flat open position with one handle folded outward.

Referring initially to FIGS. 1 and 2, there is illustrated a disposable umbrella, generally designated 10, of the present invention. FIG. 1 is a perspective view of the umbrella 10 open for use and FIG. 2 is a bottom perspective view with the umbrella partially opened for use. The umbrella 10 has a frame 12 on which there is stretched a canopy 14. The frame is die-cut from a corrugated cardboard panel and the canopy 14 is an opaque thin vinyl plastic film or sheet laminated onto the frame making the umbrella 10 water proof and able to shield out strong sun rays.

The frame 12 is square or rectangular shaped measuring approximately two feet by two feet for a most practical size. A center fold line 16 divides the frame 12 into two side panels 18. A pair of fold out right triangular tongues 20 are die-cut along cut line 22 on each side of the center fold line 16. One edge 21 of each tongue 20 is parallel to the center fold line 16 when the umbrella 10 is closed. The tongues 20 fold away from the side panels 18 along fold lines 24 perpendicular to the center fold line 16 and in the same plane with each other. Each triangular tongue 20 also has a hypotenuse edge 25 between the edge 21 and the fold line 24. An extended portion forms a handle 26 in each tongue 20 lying in the plane of the tongue 20 and perpendicular to the fold line 24. If desired, the handles 26 may be optionally reinforced with a wooden stick 27 adhered thereto by suitable adhesive.

A second piece of material 50 is laminated and adhered by suitable adhesive to the outside 51 of the frame 12 to form the canopy 14 on the upper side of the frame. The material 50 has the same overall size as the frame 12. An advertising message 48 may be imprinted on the upper side of the canopy 14.

A carry handle 28 is provided for carrying the umbrella 10 in folded flat, non-use position. The carry handle 28 comprises a thong 30 extending through holes 32 in the canopy 14 and frame 12 along the fold line 16 and secured either by a knot at each end or by connecting the ends together to form a loop. Loop and hook pile mating fastener pads 34 and 36 such as sold under the trademark Velcro securely hold the side panels 18 together in closed, non-use position.

To open for use, the tongues 20 are folded downwardly along the fold lines 24 and the side panels 18 are then folded along the fold line 16 until both handles 26 are aligned adjacent each other. A hand may then gasp both handles 26 retaining the side panels 18 in a peak-roof-shape as shown in FIG. 1 for protecting a person 38 from rain or sun.

Figure 3:
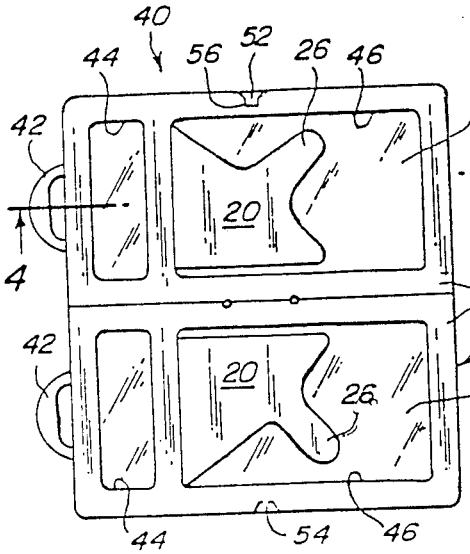
FIG. 3 is a bottom plan view of another embodiment of the present invention in a flat open position.
Figure 4:
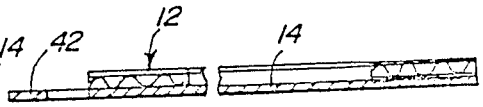
FIG. 4 is an enlarged cross sectional view taken along the line 4—4 in FIG. 3.

Another embodiment of the disposable umbrella, generally designated 40, is shown in FIGS. 3 and 4. FIG. 3 is a bottom plan view of the umbrella 40 in a flat open position and FIG. 4 is an enlarged cross sectional view along the line 4—4 of FIG. 3. Elements of the umbrella 40 that are similar to the elements of the umbrella 10 in FIGS. 1 and 2 have identical reference numerals. A pair of aligned die-cut loops 42 along one edge of the frame 12 are substituted for the carry handle 28 of umbrella 10 in FIG. 1. Cut-out areas 44 and 46 in the frame 12 lighten the frame without a noted loss of strength. A tab 52 is substituted for the loop and hook pile mating fastener pads 34 and 36. The tab 52 is foldable about a line 56 and fits into a corresponding mating notch 54 in the other side allowing the umbrella 40 to be securely held together in a closed, non-use position.

FIG. 5 is a perspective view similar to FIG. 1 of a preferred embodiment of the disposable umbrella of the present invention, generally designated 100, with a canopy 102 stretched over a frame 104 indicated in shadow outline folded into a peak roof shape configuration ready for use. The canopy 102 is fabricated from a flexible sheet shown in FIG. 7 and the frame 104 is fabricated from a rigid sheet shown in FIG. 6.

FIG. 7 is a bottom plan view of the canopy 102. The flexible sheet material of the canopy 102 is preferably a water impermeable plastic vinyl in order to provide an inexpensive waterproof cover for the umbrella 100. The canopy 102 comprises a rectangular piece of the sheet material by folding narrow panels 106 and 108 along the first and second parallel sides 110 and 112, respectively. The narrow ends 114, 116, 118, and 120 of the panels 106 and 108 are then coupled, such as by welding, to the adjacent two sides 122 and 124 to form two pockets 126 and 128.

FIG. 6 is a bottom plan view of the frame 104 in an open position after cutting and prior to bending. The frame 104 is preferrably fabricated of corrugated cardboard although plastic corrugated board, plastic foam board, plastic, or other bendable rigid sheet material may be used. If the frame 104 is fabricated of corrugated cardboard, the cardboard is preferrably coated with wax to protect the cardboard from water. A steel rule die may be used to cut the entire frame 104 with cutouts, cuts, and/or dents if desired.

The frame 104 has a rectangular shape substantially matching the outer dimensions of the canopy 102. The two ends 130 and 132 are parallel to each other and perpendicular to the frame sides 134 and 136. The frame sides 134 and 136 are also parallel to each other and spaced from each other substantially the width of the canopy 102. A center fold line 138 parallel to the frame sides 134 and 136 defines two substantially equal sized side panels 140 and 142. The center fold line 138 is initially dent or cut into the rigid sheet material in the direction of the corrugations in order to permit the rigid sheet material to be accurately bent. Tongues 144 and 146 are cut in the side panels 140 and 142, respectively, creating open areas 148 and 150. Tongue fold lines 152 and 154 are initially dented into the sheet material perpendicular to the center fold line 138 to allow the tongues 144 and 146 to be folded out. Handles 156 and 158 cut on the tongues 144 and 146 are sized to facilitate gripping by a hand. When the handles 156 and 158 are lifted and brought into alignment with each other, the side panels 140 and 142 are bent around the center fold line 138 into the peak-roof shape illustrated in FIG. 5. A locking tab 160 and a tab lock opening 162 cut into the tongues 144 and 146 allow the tongues to be retained together in the aligned position when the locking tab is positioned in the tab lock opening.

Figure 14:
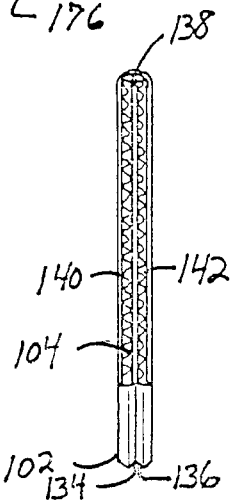
FIG. 14 is an end elevational view of the embodiment of FIG. 13 in a closed position.

The canopy 102 of FIG. 7 is installed on the frame 104 of FIG. 6 by bending the frame along the center fold line 138 until the frame sides 134 and 136 of the side panels 140 and 142 touch in a closed position illustrated in FIG. 14. The frame 104 is then bent in the reverse direction indicated by the arrow 164 in FIG. 8 around the center fold line 138. The frame side 134 is slipped into the pocket 126 of the canopy 102 and the other frame side 136 is slipped into the other pocket 128 in the direction of the arrow 166. The frame 104 is then returned to the closed position illustrated in FIG. 14 retaining the canopy 102 on the frame and insuring the proper positioning of the frame sides 134 and 136 in the side pockets 126 and 128.

FIG. 9 is a partial end elevational view of the frame 104 of FIG. 8 bent to the normal use position with the canopy 102 installed on the upper surface 168. The locking tab 160 on the first tongue 144 has been bent through the tab lock opening 162 in the second tongue 146 thereby locking the tongues together in an aligned position to retain the umbrella 100 in a peak-roof shape.

Figure 10:
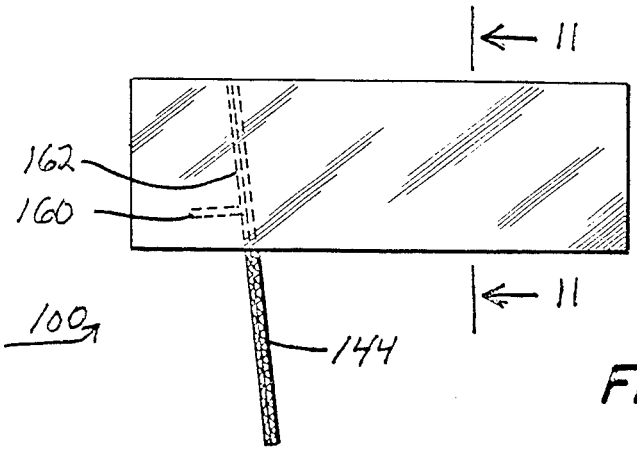
FIG. 10 is side elevational view of the embodiment of FIG. 5.

FIG. 10 is side elevational view of the umbrella 100 in the peak-roof shape. The position of the locking tab 160 on the first tongue 144 through the tab lock opening 162 in the second tongue 146 is clearly shown.

Figure 11:
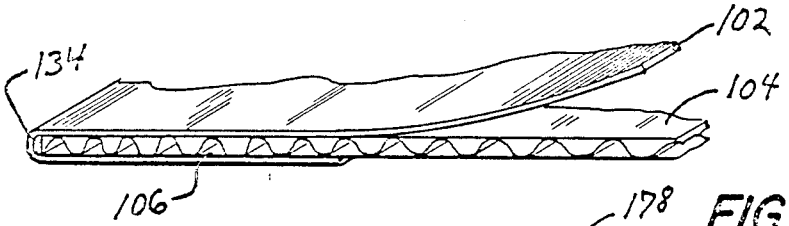
FIG. 11 is an enlarged sectional view along the line 11—11 of FIG. 10 with one side of the canopy raised.

FIG. 11 is a partial enlarged sectional view along the line 11—11 of FIG. 10 with one side of the canopy 102 slightly raised separating the canopy from the corrugated cardboard frame 104. The canopy 102 is folded around the frame side 134 forming the pocket 106. It will be appreciated that corrugated board fabricated of plastic and similar in appearance to the corrugated cardboard may be used instead of the corrugate cardboard.

Figure 12:
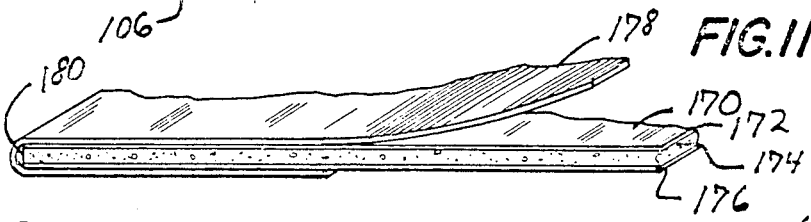
FIG. 12 is an enlarged sectional view similar to FIG. 11 of another embodiment of the present invention having a plastic frame.

FIG. 12 is an enlarged sectional view similar to FIG. 11 of another embodiment of the present invention having a solid plastic frame 170. The plastic frame 170 may be fabricated either of one layer of plastic or a sandwich of layers with a hard upper layer 172, a foam core 174, and a hard bottom layer 176. The canopy 178 fits over the frame side 180 in the same manner as in FIG. 11.

Figure 13:
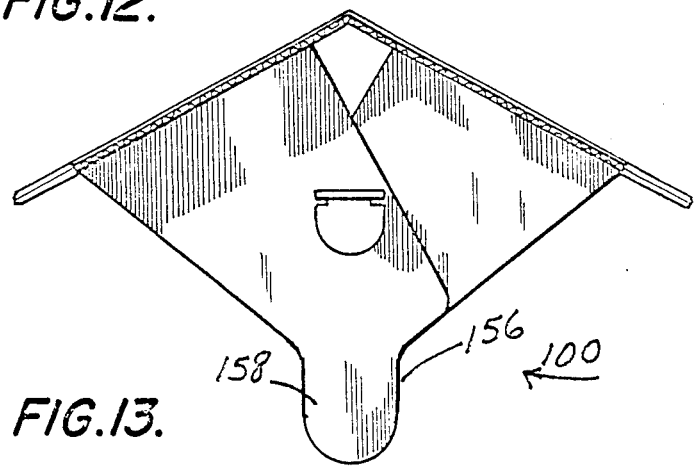
FIG. 13 is an end elevational view of the embodiment of FIG. 5 open for use.

FIG. 13 is an end elevational view of the umbrella 100 of FIG. 5 open for use. The handles 156 and 158 are in complete alignment allowing the combined handles to be easily held by one hand.

Figure 15:
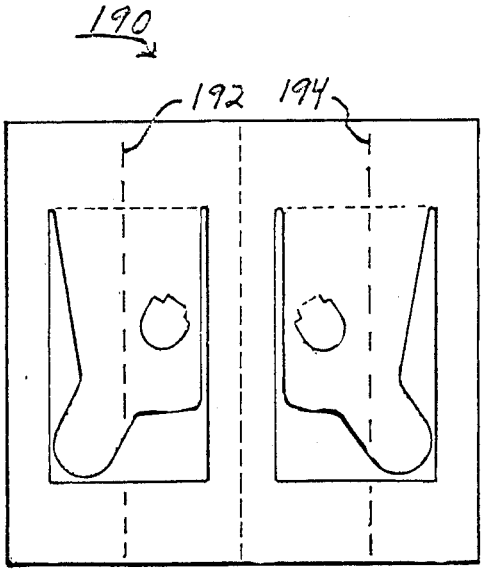
FIG. 15 is a bottom plan view of another embodiment of the present invention.
Figure 16:
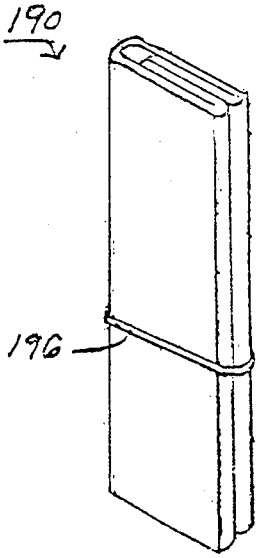
FIG. 16 is a perspective view of the embodiment of FIG. 15 folded.

FIG. 15 is a bottom plan view of another embodiment of the umbrella, generally designated 190. The umbrella 190 is identical to the umbrella 100 of FIG. 5 except for the addition of folding lines 192 and 194 along the length of the umbrella. The folding lines 192 and 194 allow the umbrella 190 to be folded into quarters as illustrated in FIG. 16. A rubber band 196 may be utilized to retain the umbrella 190 in the folded condition.

In view of the above, it may be seen that a disposable umbrella and method of manufacture are provided. Of course, the structure and method may be variously implemented, performed, and used depending upon specific applications. Accordingly, the scope hereof shall not be referenced to the disclosed embodiments, but on the contrary, shall be determined in accordance with the claims as set forth below.

I claim:

1. A disposable umbrella, comprising a flexible waterproof film and a frame having the film secured to the outside thereof, the frame comprising a single, rigid sheet having:

a fold line for folding the frame, the fold line forming two panels having opposing sides; and two foldout tongues positioned respectively on each side of the fold line, each tongue being partially cut from the frame and having a tongue foldout line to permit folding of the tongue away from the frame to form an open area in the frame, the tongues being adapted to cooperatively form a handle and position the umbrella in a peak-roof shape.

2. The umbrella of claim 1 wherein the film comprises a canopy formed by folding narrow panels thereof to form two pockets along first and second sides, said pockets receiving the sides of the panels so as to retain the canopy on the frame.

3. The umbrella of claim 1 or 2 wherein the frame and tongues are formed from a single die-cut sheet.

4. An umbrella, comprising:

a canopy comprising a flexible water-impermeable film having first and second sides, each side having a pocket formed therein; and a frame comprising a rigid sheet having outer dimensions substantially matching the outer dimensions of the canopy;

the frame having:

sides spaced from each other substantially the width of the canopy;

a fold line defining two side panels on either side of the centerfold line allowing the side panels to be bent toward each other until the sides touch in a closed position;

a tongue formed by cutting through each of the side panels, each of the tongues having a tongue fold line for folding out the tongue and forming a handle; and one of the frame sides removably received in the first pocket and the other of the frame sides removably received in the second pocket.

5. An umbrella according to claim 4 wherein one of the tongues further includes a locking tab and the other tongue has a tab lock opening for selectively receiving the locking tab to retain the tongues together in an aligned position.

6. The umbrella of claim 4 or 5 wherein the frame and tongues are formed from single die-cut sheet.

7. A disposable umbrella, comprising a canopy comprising a flexible waterproof film and a frame having the film secured to the outside thereof, the frame comprising a sheet having:

essentially parallel and opposing edges;

a fold line for folding the frame and canopy, the fold line forming two panels having essentially parallel and opposing sides;

two foldout tongues positioned respectively on each side of the fold line, each of the tongues being cut from the frame and forming open areas in the frame, the tongues having foldout lines parallel to each other for folding out the tongues, the tongues forming a handle adjacent one of the frame edges and interlocking to position the umbrella in a peak-roof shape.

8. The umbrella of claim 7 wherein the canopy comprises a piece of film formed by folding narrow panels thereof to form two pockets along first and second sides, said pockets receiving the sides of the panels so as to retain the canopy on the frame.

9. The umbrella of claim 7 or 8 wherein the frame and tongues are formed from a single die-cut sheet.

10. A method for constructing an umbrella, comprising the steps of:

folding narrow panels along two sides of a flexible film;

coupling the narrow panels to the adjacent two sides of the flexible film to form a canopy having two side pockets;

cutting a rigid sheet into a frame having outer dimensions substantially matching the outer dimensions of the canopy, the frame having a fold line with side panels on either side thereof, and capable of being bent until the sides of said side panels touch in a closed position;

reverse bending said frame in an opposite direction along the fold line and slipping one of the sides of said frame into one of the side pockets and the other of the sides into the other of the side pockets; and returning the frame to the closed position with the canopy retained on the frame.

11. The method recited in claim 10 wherein the step of cutting includes cutting the frame to form a tongue on each side of the fold line, and which further includes bending the tongues along tongue fold lines into planes being substantially perpendicular to the respective side panels to form a handle and position the umbrella in a peak-roof shape.

12. The method recited in claim 11 wherein the step of cutting further includes cutting a locking tab in one of the tongues and a tab lock opening in the other tongue, and further comprising the step of bending the locking tab into the tab lock opening to secure the tongues together in an aligned position.

13. The method of claim 10, 11 or 12 wherein the frame and tongues are formed from a single die-cut sheet.

* * * * *

UNITED STATES PATENT AND TRADEMARK OFFICE

CERTIFICATE OF CORRECTION

PATENT NO. : 4,754,773

DATED : July 5, 1988

INVENTOR(S) : James R. Rex

It is certified that error appears in the above-identified patent and that said Letters Patent is hereby corrected as shown below:

Column 3, line 28, delete "gasp", and insert --grasp--

Column 4, line 5, delete "preferrably" and insert --preferably--

Column 4, line 68, delete "corrugate", and insert --corrugated--

Signed and Sealed this

Sixth Day of December, 1988

*Attest:*

DONALD J. QUIGG

*Attesting Officer*

*Commissioner of Patents and Trademarks*